US008360903B2

(12) United States Patent
Carlyle et al.

(10) Patent No.: US 8,360,903 B2
(45) Date of Patent: Jan. 29, 2013

(54) METHOD OF SELECTING PREFERRED CUSTOMIZED EQUIPMENT PARAMETERS FOR GOLF CLUBS

(75) Inventors: Scott A. Carlyle, Costa Mesa, CA (US); Sharon J. Park, Irvine, CA (US); John J. Rae, Westminster, CA (US); Kevin R. Tassistro, Redondo Beach, CA (US)

(73) Assignee: SRI Sports Limited, Kobe-Shi (JP)

( * ) Notice: Subject to any disclaimer, the term of this patent is extended or adjusted under 35 U.S.C. 154(b) by 242 days.

(21) Appl. No.: 12/728,710

(22) Filed: Mar. 22, 2010

(65) Prior Publication Data

US 2010/0240475 A1 Sep. 23, 2010

Related U.S. Application Data

(60) Provisional application No. 61/162,131, filed on Mar. 20, 2009.

(51) Int. Cl.
*A63B 53/00* (2006.01)

(52) U.S. Cl. ..... 473/407; 473/409

(58) Field of Classification Search ..... 473/287, 473/289, 290, 291, 407, 409
See application file for complete search history.

(56) References Cited

U.S. PATENT DOCUMENTS

| | | | | |
|---|---|---|---|---|
| 4,203,598 | A | 5/1980 | Stuff et al. | |
| 4,415,156 | A | 11/1983 | Jorgensen | |
| 5,163,681 | A | 11/1992 | Hodgetts | |
| 5,318,296 | A | 6/1994 | Adams et al. | |
| 5,351,951 | A | 10/1994 | Hodgetts | |
| 5,351,953 | A | 10/1994 | Mase | |
| 5,591,091 | A | 1/1997 | Hackman | |
| 5,879,241 | A | 3/1999 | Cook et al. | |
| 5,951,410 | A | 9/1999 | Butler et al. | |
| 6,083,123 | A | 7/2000 | Wood | |
| 6,328,660 | B1 | 12/2001 | Bunn, III | |
| 6,602,147 | B2 * | 8/2003 | Shiraishi | 473/291 |
| 6,719,648 | B1 * | 4/2004 | Smith | 473/409 |
| 6,966,843 | B2 | 11/2005 | Rankin et al. | |
| 7,056,225 | B1 | 6/2006 | Pipkin | |
| 7,147,570 | B2 | 12/2006 | Toulon et al. | |
| 7,153,215 | B2 | 12/2006 | Peterson et al. | |
| 7,166,035 | B2 | 1/2007 | Voges et al. | |
| 7,195,565 | B2 | 3/2007 | White et al. | |
| 7,297,070 | B2 | 11/2007 | Ashida et al. | |
| 7,300,358 | B2 | 11/2007 | Noble | |
| 7,413,517 | B2 | 8/2008 | Butler, Jr. et al. | |
| 2002/0072429 | A1 * | 6/2002 | Rankin et al. | 473/287 |
| 2002/0119828 | A1 * | 8/2002 | Toulon et al. | 473/287 |
| 2003/0008731 | A1 | 1/2003 | Anderson et al. | |
| 2003/0073507 | A1 * | 4/2003 | Shiraishi | 473/287 |

(Continued)

*Primary Examiner* — Vishu K. Mendiratta
(74) *Attorney, Agent, or Firm* — Oliff & Berridge, PLC

(57) ABSTRACT

A method of selecting preferred customized equipment parameters for golf clubs, according to one or more aspects of the present invention, may comprise collecting a primary data set comprising a plurality of actual golf-equipment parameters and a plurality of actual player-skill evaluation data; providing a plurality of secondary data sets, each comprising a first subset including a plurality of reference golf-equipment parameters and a plurality of reference player-skill evaluation data, and a second subset including a plurality of potential customized golf-equipment parameters; comparing the first subset of each of the plurality of secondary data sets with a corresponding subset of the primary data set; selecting all secondary data sets wherein the first subsets match the corresponding subset of the primary data set; identifying, from the second subsets of all the secondary data sets wherein the first subsets match the corresponding subset of the primary data set, the plurality of potential customized golf-equipment parameters belonging to a specific secondary data set; and designating the plurality of potential customized equipment parameters belonging to the specific secondary data set as the plurality of preferred customized golf-equipment parameters.

2 Claims, 7 Drawing Sheets

116 118 122

| # of Wedges | Scoring Club | LW | Reference Handicap Categories 1 2 3 4 | Selected SGD Shot Types 1 2 3 4 5 | SGD Score Average For The Selected Shot Types | PW | GW | SW | LW | SLW |
|---|---|---|---|---|---|---|---|---|---|---|
| 2 | 0 | 0 | - - x x | x - - x - | Below 2.5 | 46° | | 56° | | |
| 2 | 0 | 0 | - - x x | x - - x - | Below 2.5 | 48° | | 56° | | |
| 2 | 0 | 1 | x x x - | x x x x x | Above 3.19 | 46° | 52° | | 58° | |
| 2 | 0 | 1 | x x x - | x x x x x | Above 3.19 | 46° | | 54° | 60° | |
| 2 | 0 | 1 | x x x - | x x x x x | Above 3.19 | 48° | | 54° | 58° | |
| 2 | 0 | 1 | x x x - | x x x x x | Above 3.19 | 48° | | 54° | 60° | |

114 120

112

U.S. PATENT DOCUMENTS

| | | | | |
|---|---|---|---|---|
| 2005/0079932 | A1 | 4/2005 | Voges et al. | |
| 2005/0196737 | A1 * | 9/2005 | Mann | 434/247 |
| 2007/0167249 | A1 | 7/2007 | Voges et al. | |
| 2008/0305882 | A1 | 12/2008 | Noble et al. | |
| 2009/0069908 | A1 | 3/2009 | Butler, Jr. et al. | |
| 2009/0088275 | A1 | 4/2009 | Solheim et al. | |
| 2009/0088276 | A1 | 4/2009 | Solheim et al. | |
| 2009/0131189 | A1 | 5/2009 | Swartz et al. | |
| 2009/0131193 | A1 | 5/2009 | Swartz et al. | |
| 2010/0022331 | A1 * | 1/2010 | Schneider | 473/409 |

* cited by examiner 102 104

| CLUB | Y/N | LOFT° | DISTANCE |
|---|---|---|---|
| 9 Iron | Y | 41° | 120 |
| Pitching Wedge | Y | 45° | 110 |
| Gap Wedge | N | -- | -- |
| Sand Wedge | Y | 56° | 80 |
| Lob Wedge | N | -- | -- |
| Super Lob Wedge | N | -- | -- |
| Scoring Club | N | N/A | N/A |

Table 1

104

| HANDICAP | CATEGORY | PLAYER DATA |
|---|---|---|
| <5 | 1 | -- |
| 5-10 | 2 | -- |
| 10-20 | 3 | X |
| >20 | 4 | -- |

Table 2

104

| SHOT TYPE | NUMBER OF POINTS |
|---|---|
| Chip (Shot 1) | 1 |
| Bunker (Shot 2) | 3 |
| Flop (Shot 3) | 1 |
| Long Pitch (Shot 4) | 2 |
| Full Wedge (Shot 5) | 3 |

Table 3

100

FIG. 1

116 118 122

| # of Wedges | Scoring Club | LW | Reference Handicap Categories 1 2 3 4 | Selected SGD Shot Types 1 2 3 4 5 | SGD Score Average For The Selected Shot Types | PW | GW | SW | LW | SLW |
|---|---|---|---|---|---|---|---|---|---|---|
| 2 | 0 | 0 | - - x x | x - - x - | Below 2.5 | 46° | | 56° | | |
| 2 | 0 | 0 | - - x x | x - - x - | Below 2.5 | 48° | | 56° | | |
| 2 | 0 | 1 | x x x - | x x x x x | Above 3.19 | 46° | 52° | | 58° | |
| 2 | 0 | 1 | x x x - | x x x x x | Above 3.19 | 46° | | 54° | 60° | |
| 2 | 0 | 1 | x x x - | x x x x x | Above 3.19 | 48° | | 54° | 58° | |
| 2 | 0 | 1 | x x x - | x x x x x | Above 3.19 | 48° | | 54° | 60° | |

114 120

112

FIG. 5

METHOD OF SELECTING PREFERRED CUSTOMIZED EQUIPMENT PARAMETERS FOR GOLF CLUBS

COPYRIGHT AUTHORIZATION

The disclosure below may be subject to copyright protection. The copyright owner has no objection to the facsimile reproduction by anyone of the documents containing this disclosure, as they appear in the Patent and Trademark Office records, but otherwise reserves all applicable copyrights.

BACKGROUND

It is generally known to those skilled in the art of golf-club making that a player's performance level may be enhanced by custom fitting a set of golf clubs to the player. These custom-fit golf clubs are selected, using anyone of a plurality of fitting methods, to improve the player's ability to consistently execute well-struck shots. Most fitting methods require a player to perform one or more golf swings using a single test club, e.g., a 6 iron. The collected data is then extrapolated to the rest of the clubs with the set. However, a player who is fitted into a custom set using a single test club may later discover a non-uniform shot-distance progression between the clubs within the set. Accordingly, the player may have difficulty selecting the appropriate golf clubs from the set for various shots during a golf round.

SUMMARY

The present invention, in one or more aspects thereof, may advantageously comprise a method of selecting a plurality of golf clubs that delivers a more uniform shot distance progression from club to club.

In one example, a method of selecting preferred customized equipment parameters for golf clubs, according to one or more aspects of the present invention may comprise collecting a primary data set comprising a plurality of actual golf-equipment parameters and a plurality of actual player-skill evaluation data; providing a plurality of secondary data sets, each comprising a first subset including a plurality of reference golf-equipment parameters and a plurality of reference player-skill evaluation data, and a second subset including a plurality of potential customized golf-equipment parameters; comparing the first subset of each of the plurality of secondary data sets with a corresponding subset of the primary data set; selecting all secondary data sets wherein the first subsets match the corresponding subset of the primary data set; identifying, from the second subsets of all the secondary data sets wherein the first subsets match the corresponding subset of the primary data set, the plurality of potential golf-customized equipment parameters belonging to a specific secondary data set; and designating the plurality of potential customized golf-equipment parameters belonging to the specific secondary data set as the plurality of preferred customized golf-equipment parameters.

These and other features and advantages of the method according to the invention in its various aspects, as provided by one or more of the examples described in detail below, will become apparent after consideration of the ensuing description, the accompanying drawings, and the appended claims. The accompanying drawings are for illustrative purposes only and are not intended to limit the scope of the present invention.

BRIEF DESCRIPTION OF THE DRAWINGS

FIG. 1 illustrates a plurality of exemplary input tables for collecting a primary data set corresponding to the player's actual golf-equipment parameters and skill level.

FIG. 5 is a look-up table for identifying potential customized golf-equipment parameters.

DESCRIPTION

A method of selecting preferred customized equipment parameters for golf clubs, e.g., of the iron type, is disclosed. Those skilled in the art will appreciate the applicability of this method to right-handed as well has left-handed clubs. Similarly, this method is applicable to wedges as well as irons.

Figure 2:
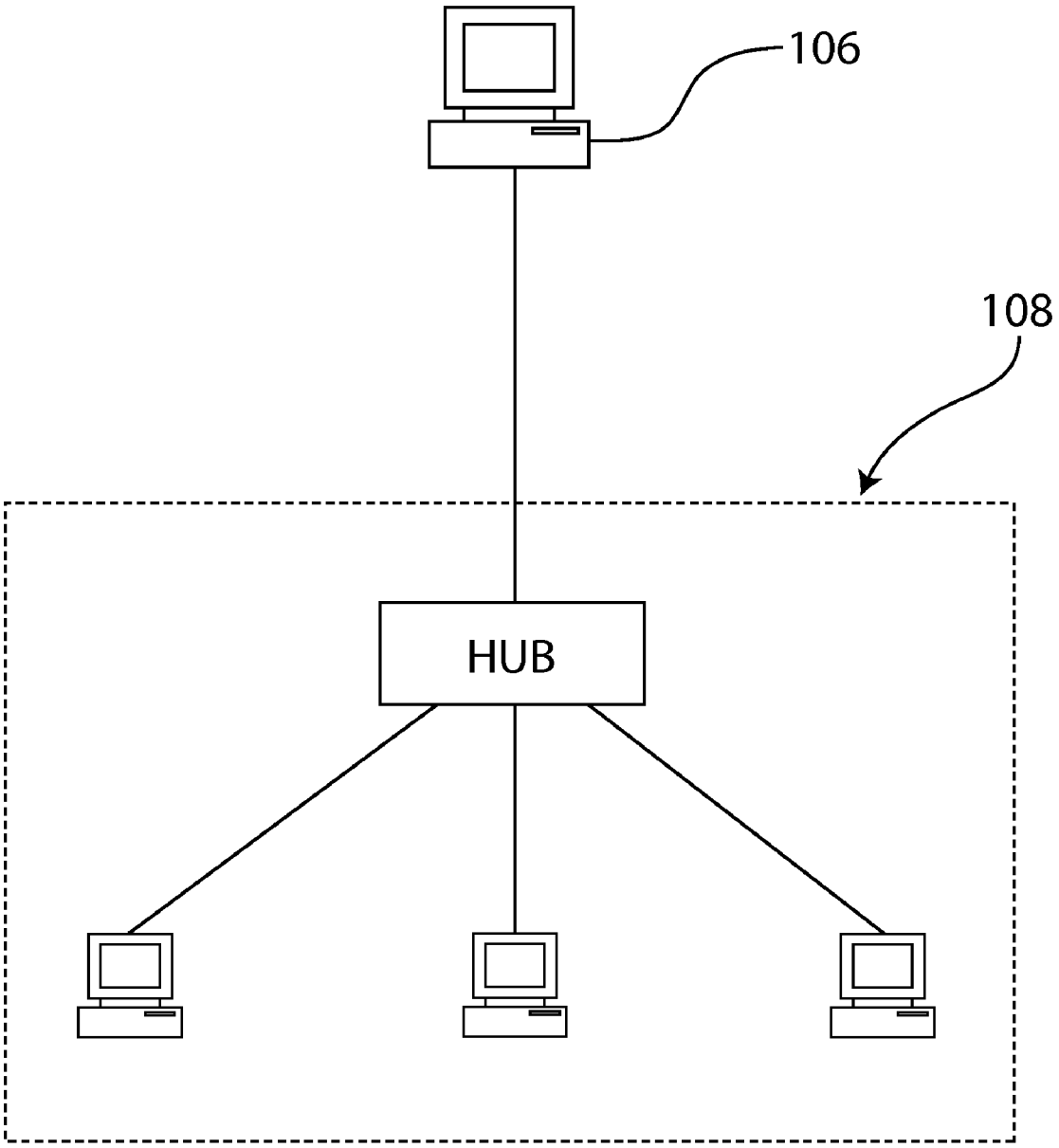
FIG. 2 is a schematic diagram of a data-processing device that is coupled with a local area network.
Figure 3:
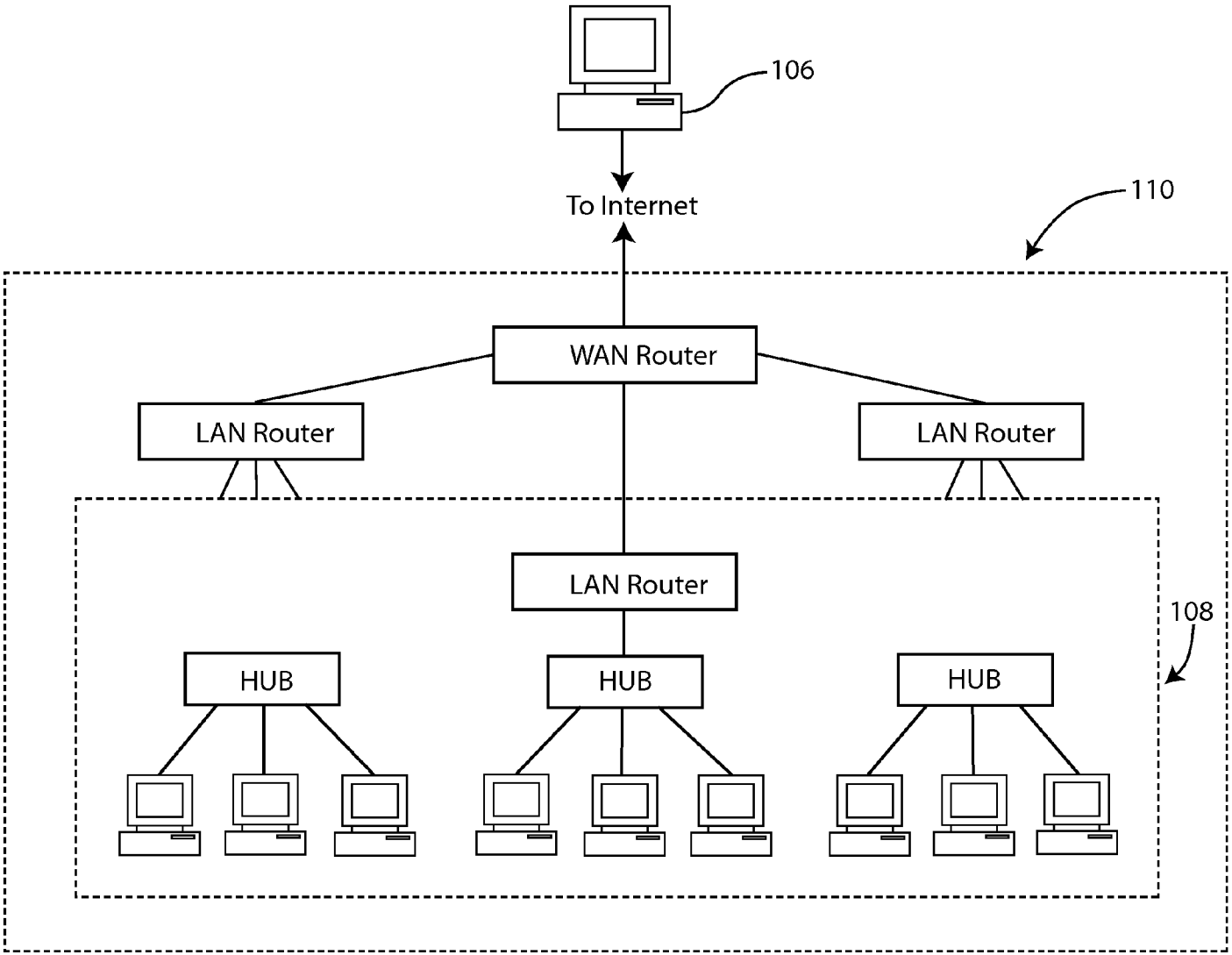
FIG. 3 is a schematic diagram of a data-processing device that is connected to a local area network through a wide area network.

As shown in FIG. 1, the method comprises collecting a primary data set, e.g., a primary data set 100, which includes a plurality of actual golf-equipment parameters 102 and a plurality of actual player-skill evaluation data 104. The primary data set 100 is collected from a golfer who desires to select preferred customized equipment parameters for a plurality of iron-type golf clubs. As shown in FIG. 2, the collected data may be processed through a communication device, such as a stand-alone personal computer, a personal digital assistant device, or a data terminal 106 coupled with a digital network, e.g., a local area network (LAN) 108. Alternatively, as shown in FIG. 3, the data terminal may be connected to a LAN 108 though a wide area network (WAN) 110. Those skilled in the art will appreciate that network connections may be provided not only by dedicated data lines, but also using wireless communication systems.

Referring once again to FIG. 1, according to one or more aspects of the present invention, the plurality of actual golf-equipment parameters 102 may include the number, type, and loft of iron-type clubs in actual use by the golfer, For example, as shown in Table 1, the golfer's profile may include a 9 iron with a 41° loft, a pitching wedge (PW) with a 45° loft, and a sand wedge (SW) with a 56° loft. In other examples of the present invention, the golfer's profile may additionally or alternatively include a gap wedge (GW), a lob wedge (LW), a super lob wedge (SLW), and a scoring club, i.e., a chipper, or any combination thereof.

The plurality of actual player-skill evaluation data 104, discussed with reference to FIG. 1, may include the shot distance associated with at least two clubs in the golfer's bag.

Referring once again to Table 1, exemplary shot distances associated with, e.g., the 9 iron, PW, and SW are 120 yards, 110 yards, and 80 yards, respectively.

As shown in Table 2, in one or more aspects of the present invention, the plurality of actual player-skill evaluation data 104 may also include player handicap, i.e., a numerical representation of a golfer's playing ability meant to represent a golfer's scoring potential rather than simply an average of a golfer's score. In one aspect of the invention, the golfer's handicap may be classified into four categories, e.g., less than 5 (category 1), between 5 and 10 (category 2), between 10-20 (category 3), and greater than 20 (category 4). Those skilled in the art will appreciate that handicap may be classified in a number of different ways, as desired. Table 2 shows a player handicap classified in category 3.

Figure 4:
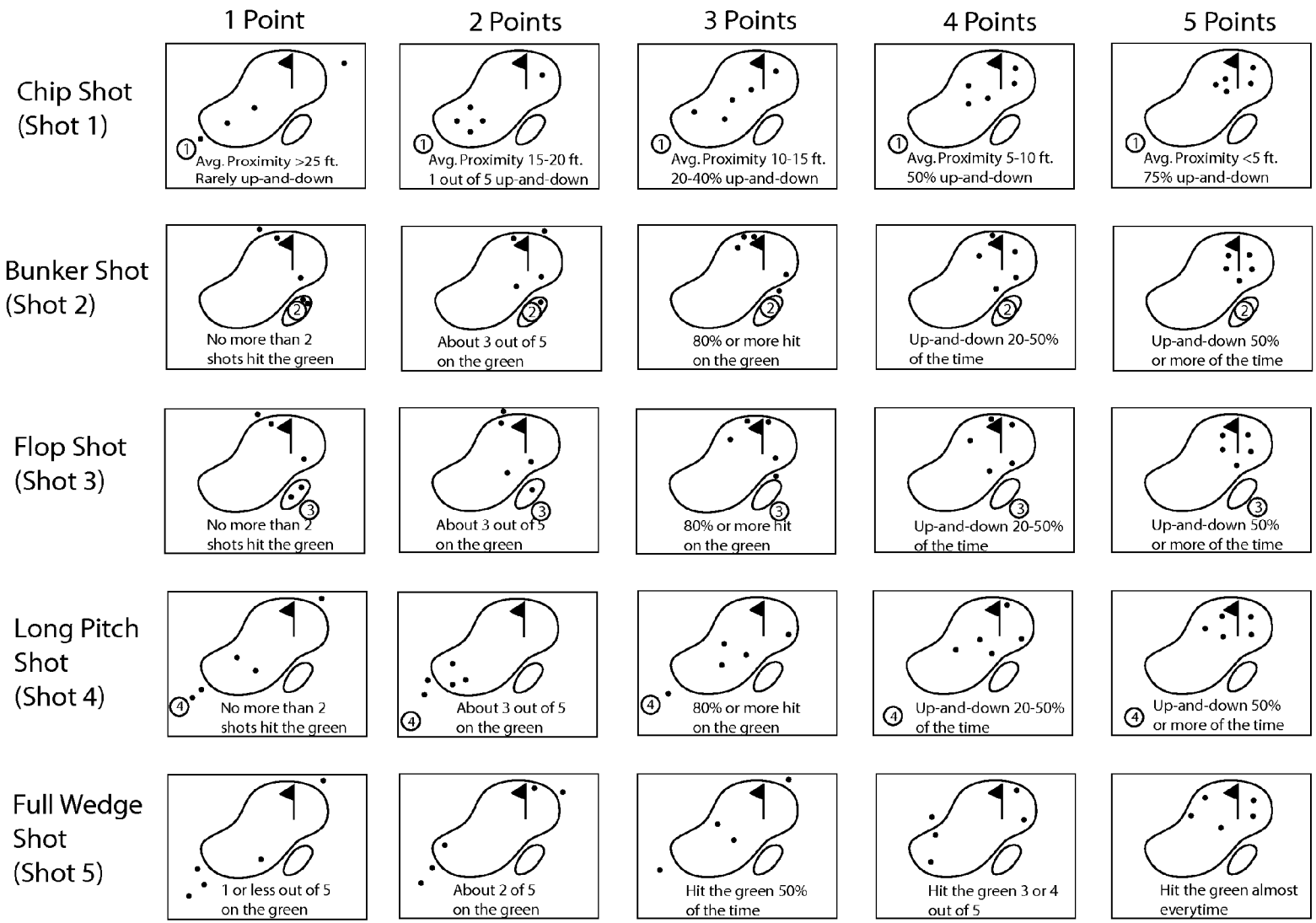
FIG. 4 illustrates an exemplary skill chart that evaluates a player's proficiency when executing various golf shots.

Referring to FIG. 4, the plurality of actual player-skill evaluation data 104 may also include a short-game diagnosis (SGD), wherein a player evaluates his or her skill level for specific shot types, e.g., a chip shot (shot 1), a bunker shot (shot 2), a flop shot (shot 3), a long pitch shot (shot 4), and a full wedge shot (shot 5). A player identifies his or her performance level by assigning a value of, e.g., 1, 2, 3, 4, or 5 points to each shot type. A short-game diagnosis score may then be obtained by selecting a value corresponding to a single shot type of interest or by averaging the values corresponding to a plurality of shot types of interest. Table 3 (FIG. 1) provides an exemplary skill evaluation by the player of the shot types described with reference to FIG. 4, i.e., the player's exemplary short-game diagnosis results.

The method according to one or more aspects of the present invention also comprises providing a look-up table or data structure including a plurality of secondary data sets 112 (FIG. 5). Each data set 112 may comprise a first subset 114 including a plurality of reference golf-equipment parameters 116 and a plurality of reference player-skill evaluation data 118. Each data set 112 may further comprise a second subset 120, including a plurality of potential customized golf-equipment parameters 122.

In one or more aspects of the invention, the reference golf-equipment parameters 116 may include data relating to a possible number of wedges and the presence or absence of a scoring club and/or lob wedge. The reference player-skill evaluation data 118 may include entries relating to possible player handicap classifications or categories, short-game diagnosis shot types, and shot-game diagnosis scores. Additionally, the potential customized golf-equipment parameters 122 may include entries relating to type and loft of clubs to be possibly selected for golfer's use.

The method according to one or more aspects of the present invention also comprises comparing the first subset 114 of each of the plurality of secondary data sets 112 with the corresponding subset of the primary data set 100. For example, the reference golf-equipment parameters 116 of each secondary set 112 (FIG. 5) are compared to the actual golf-equipment parameters 102, previously discussed with reference to Table 1 (FIG. 1). Similarly, the reference player-skill evaluation data 118 of each of the plurality of secondary data sets 112 (FIG. 5) is compared with the actual player-skill evaluation data 104, previously discussed with reference to Tables 2 and 3 (FIG. 1). As illustrated in FIG. 5, in one or more aspects of the present invention, when an exemplary SGD score average for the selected shot types 1 and 4 is below, e.g., 2.5 and the golfer excludes the lob wedge from the actual golf-equipment parameters 102 (Table 1, FIG. 1), one or more secondary subsets 120, corresponding to one or more first subsets 114 wherein the exemplary SGD score average for the selected shot types 1 and 4 is below 2.5, are chosen. Similarly, when an exemplary SGD score average for the selected shot types 1-5 is above, e.g., 3.19 and the golfer includes the lob wedge in the actual equipment parameters 102 (Table 1, FIG. 1), one or more secondary subsets 120, corresponding to one or more subsets 114 wherein the exemplary SOD score average for the selected shot types 1-5 is above 3.19, are chosen.

Those skilled in the art will appreciate that the fields and/or entries in the look-up table or data structure embodying the secondary data sets 112 may be arranged in different ways to accommodate a variety of club types (e.g., putters, scoring clubs, wedges, irons, hybrids, and woods), selection-logic requirements, and player profiles.

Additionally, the method according to one or more aspects of the present invention comprises identifying, from the second subsets 120 of all the secondary data sets 112 wherein the first subsets 114 match the corresponding subset of the primary data set 100, the plurality of potential customized golf-equipment parameters 122 belonging to a particular secondary data set 112. More specifically, the plurality of potential customized golf-equipment parameters 122 belonging to a particular secondary data set 112 may be identified as follows.

Figure 6:
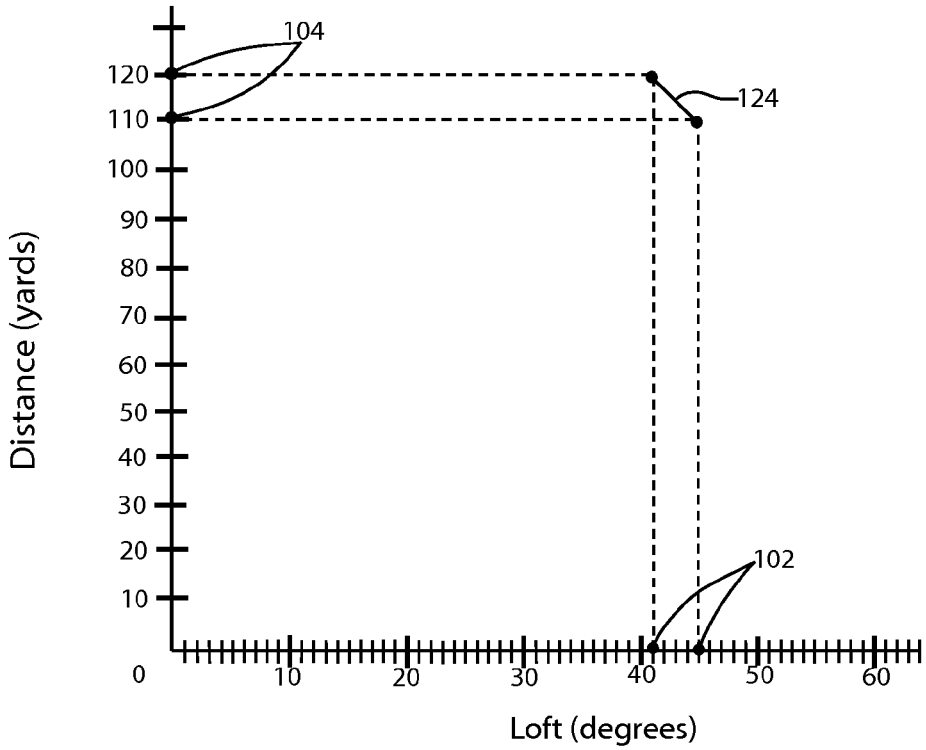
FIG. 6 is a graphical representation of an exemplary gap function, according to one or more aspects of the present invention.
Figure 7:
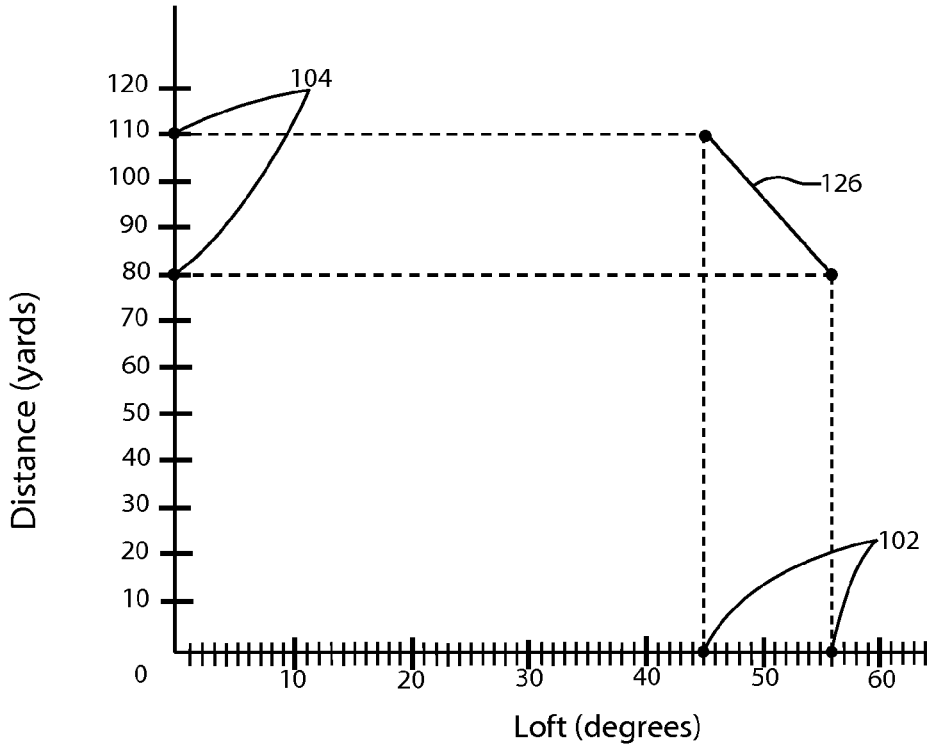
FIG. 7 is a graphical representation of an exemplary gap function, according to one or more aspects of the present invention.

A plurality of functions relating the plurality of actual golf-equipment parameters 102 and the plurality of actual player-skill evaluation data 104 are defined, as shown in FIGS. 6 and 7. For example, FIG. 6 shows a gap function or gap segment 124, defined by two points corresponding to actual golf-equipment parameters 102, e.g., player-profile loft, and actual player-skill evaluation data 104, e.g., player-profile overall shot distance, associated with the 9 iron and the pitching wedge (PW), respectively. Similarly, FIG. 7 shows a gap function or gap segment 126, defined by two points corresponding to actual golf-equipment parameters 102, e.g., player-profile loft, and actual player-skill evaluation data 104, e.g., player-profile overall shot distance, associated with the pitching wedge (PW) and the sand wedge (SW), respectively. Those skilled in the art will appreciate that the number of gap functions or gap segments relating the plurality of actual golf-equipment parameters 102 and the plurality of actual player-skill evaluation data 104 will depend on the number of clubs included in the golfer's profile and will be defined between pairs of data points corresponding to consecutively lofted clubs included in the golfer's profile, as presented in Table 1 (FIG. 1).

Lines containing gap functions or gap segments may be mathematically described in the form $y=mx+b$, where x corresponds to loft of the golf club, y corresponds to the overall distance associated with the golf club having a given loft x, m corresponds to the slope of the line, and b corresponds to the y-intercept of the line containing a given gap segment.

Figure 8:
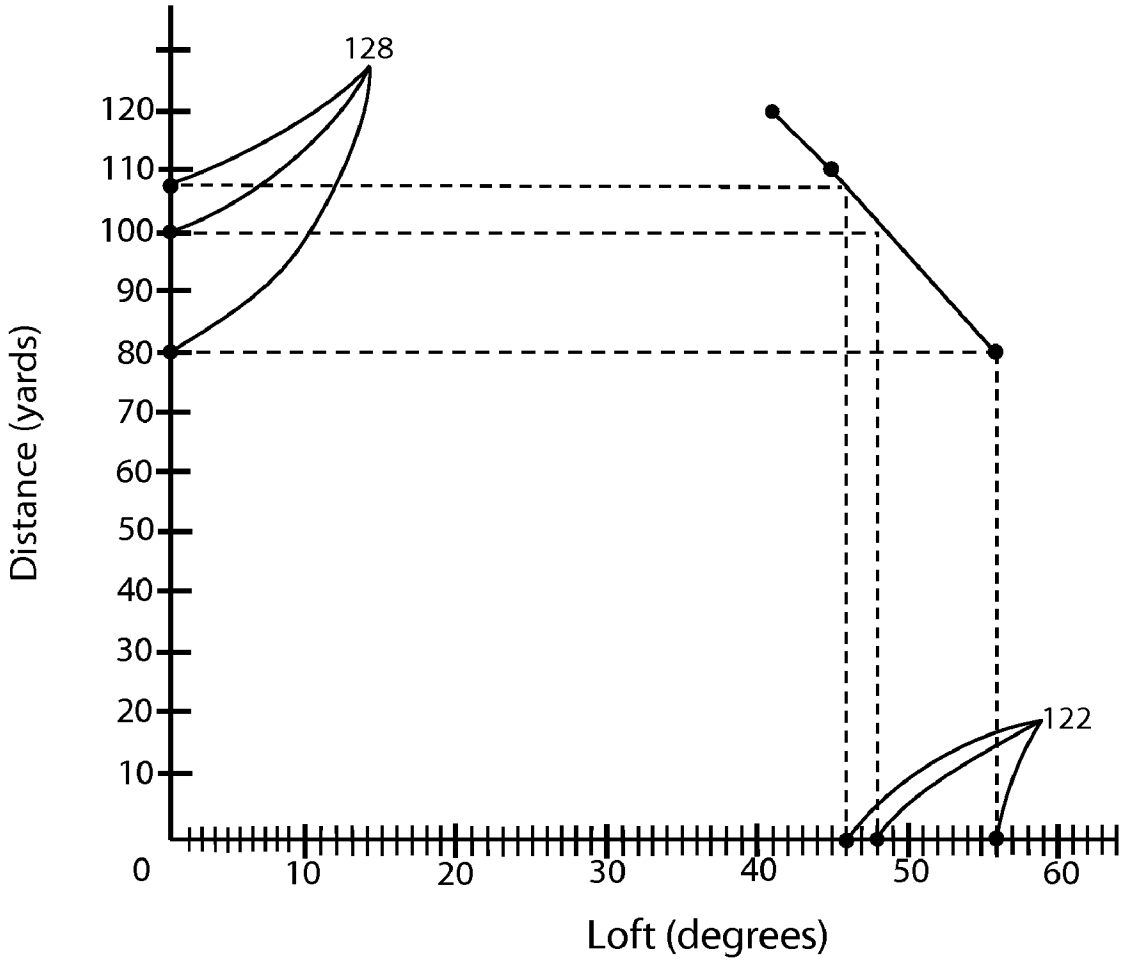
FIG. 8 is a graphical representation of the gap functions of FIGS. 6 and 7.

Once the plurality of functions relating the plurality of actual golf-equipment parameters 102 and the plurality of actual player-skill evaluation data 104 are defined, e.g., as described with reference to FIGS. 6 and 7, above, these functions are applied to the potential customized golf-equipment parameters 122, associated with the second subsets 120 of all the secondary data sets 112 wherein the first subsets 114 match the corresponding subset of the primary data set 100, to generate potential player-skill evaluation data points 128, as shown in FIG. 8. It will be appreciated that potential customized golf-equipment parameters 122, falling outside the range of lofts encompassed by the defined gap functions or gap segments, may result in the closest loft encompassed by the gap segments being utilized to generate the corresponding potential player-skill evaluation data 128.

The potential player-skill evaluation data 128, obtained for each potential customized equipment parameter 122 of each of the secondary data sets 112 wherein the first subsets 114 match the corresponding subset of the primary data set 100, is used to generate a gap indicator having a specific value. The gap indicator is calculated by squaring the value of each potential player-skill evaluation datum 128 associated with a particular secondary data set 112 and adding the squared values together. The gap indicator values for all secondary data sets 112 wherein the first subsets 114 match the corresponding subset of the primary data set 100 are then compared to each other, the gap indicator having the lowest value is selected, and the specific secondary data set 112 corresponding to the lowest gap indicator is identified. The plurality of potential customized golf-equipment parameters 122, belonging to the specific secondary data set 112 corresponding to the lowest gap indicator, are designated as the plurality of preferred customized equipment parameters for a plurality of golf clubs, which deliver a more evenly distributed yardage gap from club to club to improve shot consistency.

In the foregoing specification, the invention has been described with reference to specific exemplary aspects thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

What is claimed is:

1. A method of selecting a plurality of preferred customized equipment parameters for a plurality of golf clubs, the method comprising:

providing a computer, the computer being configured to:

receive entry of information, process the received information, and display the processed information;

collecting a primary data set comprising a plurality of actual golf-equipment parameters and a plurality of actual player-skill evaluation data using the computer, wherein, the plurality of actual golf-equipment parameters includes number, type, and loft of iron-type clubs in actual use by a golfer, and the plurality of actual player-skill evaluation data includes shot distance associated with at least two golf clubs in a golfer's bag, a player's handicap, and a short-game diagnosis;

providing a plurality of secondary data sets each comprising a first subset including a plurality of reference golf-equipment parameters and a plurality of reference player-skill evaluation data, and a second subset including a plurality of potential customized golf-equipment parameters using the computer, wherein the plurality of reference golf-equipment parameters includes data relating to a possible number of wedges and presence or absence of a scoring club and/or lob wedge, the plurality of reference player-skill evaluation data includes entries relating to possible player handicap classifications or categories, short-game diagnosis shot types, and shot-game diagnosis scores, and the plurality of potential customized golf-equipment parameters includes entries relating to type and loft of clubs to be selected for a golfer's use;

comparing the first subset of each of the plurality of secondary data sets with a corresponding subset of the primary data set using the computer;

selecting all secondary data sets wherein the first subsets match the corresponding subset of the primary data set using the computer;

identifying, from the second subsets of all the secondary data sets wherein the first subsets match the corresponding subset of the primary data set, the plurality of potential customized golf-equipment parameters belonging to a specific secondary data set using the computer; and designating the plurality of potential customized golf-equipment parameters belonging to the specific secondary data set as the plurality of preferred customized golf-equipment parameters using the computer.

2. The method of claim 1, wherein identifying, from the second subsets of all the secondary data sets wherein the first subsets match the corresponding subset of the primary data set, the plurality of potential customized golf-equipment parameters belonging to a specific secondary data set, comprises:

defining a plurality of functions relating the plurality of actual golf-equipment parameters and the plurality of actual player-skill evaluation data using the communication device;

applying the plurality of functions to the potential customized golf-equipment parameters, associated with the second subsets of all the secondary data sets wherein the first subsets match the corresponding subset of the primary data set, to generate potential player-skill evaluation data using the communication device; and for each of the secondary data sets wherein the first subsets match the corresponding subset of the primary data set, generating a gap indicator associated with the potential player-skill evaluation data, the gap indicator having a value; and selecting the specific secondary data set having the gap indicator with a lowest value using the communication device.

* * * * *